US005262581A

United States Patent [19]

Sharp

[11] Patent Number: 5,262,581

[45] Date of Patent: Nov. 16, 1993

[54] METHOD AND APPARATUS FOR READING SELECTED WAVEFORM SEGMENTS FROM MEMORY

[75] Inventor: Paul H. Sharp, Aloha, Oreg.

[73] Assignee: Rodgers Instrument Corporation, Hillsboro, Oreg.

[21] Appl. No.: 611,407

[22] Filed: Nov. 9, 1990

[51] Int. Cl.[5] ..... G10H 7/04

[52] U.S. Cl. ..... 84/603; 84/605

[58] Field of Search ..... 84/605, 607, 603, 604, 84/606

[56] References Cited

U.S. PATENT DOCUMENTS

| | | | |
|---|---|---|---|
| 3,515,792 | 6/1967 | Deutsch | 84/605 |
| 4,202,234 | 5/1980 | Comerford | 84/607 |
| 4,246,617 | 1/1981 | Portnoff | 360/32 |
| 4,348,928 | 9/1982 | Sakashita et al. | 84/604 |
| 4,442,745 | 4/1984 | Gross et al. | 84/607 |
| 4,444,082 | 4/1984 | Whitefield | 84/625 |
| 4,461,199 | 7/1984 | Hiyoshi et al. | 84/605 |
| 4,502,361 | 3/1985 | Viitanen et al. | 84/627 |
| 4,520,708 | 6/1985 | Wachi | 84/607 |
| 4,584,921 | 4/1986 | Wachi | 84/605 |
| 4,611,522 | 9/1986 | Hideo | 84/607 |
| 4,683,793 | 8/1987 | Deutsch | 84/607 |
| 4,696,214 | 9/1987 | Ichiki | 84/603 |
| 4,893,538 | 1/1990 | Masaki et al. | 84/605 |
| 5,086,685 | 2/1992 | Hanzawa et al. | 84/605 |

*Primary Examiner*—William M. Shoop, Jr.
*Assistant Examiner*—Brian Sircus
*Attorney, Agent, or Firm*—Edward B. Anderson

[57] ABSTRACT

An electronic musical instrument having fewer note generators than notes stores in a sequentially addressable memory different waveform segments corresponding to different sounds. The note generators are time multiplexed by a processor, and use end addresses of current waveform segments to determine whether each current sample to be read is within the desired waveform segment. This limits the ability to noiselessly and rapidly move between segments. It is accommodated by storing a copy of the waveform segments in a readily shifted direction for immediate playout and subsequent shift to the destination waveform segment while reading the copy. This allows for cluster switching and scanning of waveform cycles to control a modulation of the base note, such as attack or tremulant, independently of the base note pitch.

21 Claims, 5 Drawing Sheets 59
60
60a
60b
62
62a
62b
64
64a
64b
66
68
70
72
74
76
78
80
82
82a
82b
8'
4'
8'& 4'
8'→8'& 4'
C2
L2
L1
C1
E1
EI
10.6EI
C3
E2
L3
P1

METHOD AND APPARATUS FOR READING SELECTED WAVEFORM SEGMENTS FROM MEMORY

FIELD OF THE INVENTION

This invention relates to electronic musical instruments, and in particular to such instruments capable of selecting waveform segments for reading from a waveform memory.

BACKGROUND OF THE INVENTION

Electronic musical instruments, such as electronic organs and synthesizers of various forms, have become very sophisticated in being able to digitally store a waveform formed of individually addressable samples. When the samples are read sequentially and converted into a signal for audio play through a speaker, a tone or sound is created representative of the stored waveform.

The desired objective, in terms or replicating actual acoustic instruments, is to make the replicated sound as natural or life-like as possible while making the instrument as economical as possible. This is generally accomplished by providing a bank of oscillators or note generators that are fewer in number than the maximum number of actuating keys and stops. Also, the smaller the memory storing the waveforms, the less expensive the instrument.

Various techniques have been developed for reading waveform memories for producing a desired sound. In U.S. Pat. No. 4,683,793, Deutsch discloses an instrument in which only half of each waveform cycle is stored. Each half cycle is read out in a forward direction and then in a reverse direction to get a complete cycle. The characteristics of the resultant waveform is provided by the characteristics of each half cycle read.

Hiyoshi et al., in U.S. Pat. No. 4,461,199, describe a system in which the time taken to read out stored samples at different octaves is achieved by providing the user with the capability of programming the number and order of waveform cycles to be sequentially read out from a waveform memory. A sustain waveform cycle must be identified that is then repeated indefinitely until a key is released. The time from the beginning of attack until release of an activating key is thereby maintained regardless of the octave played.

Hideo, in U.S. Pat. No. 4,611,522, describes a wave synthesizing apparatus in which changes in waveshapes played is accomplished by combining an elementary tone wave with a progressively changing incremental wave.

A similar approach is taught by Comerford in U.S. Pat. No. 4,202,234. With this approach, a sound is formed by interpolative sampling between two waveform cycles to produce a note with harmonic structure between the two sampled structures.

Masaki et al., in U.S. Pat. No. 4,893,538, describe an electronic musical instrument that generates tones based on plural input parameters that are used to address corresponding memory locations.

Sakashita et al., in U.S. Pat. No. 4,348,928, describe an instrument capable of producing complex musical waveshape by a tone control device. Control is provided by the use of two main memory circuits and a musical waveshape calculator.

U.S. Pat. No. 4,442,745 issued to Gross et al. and U.S. Pat. No. 4,502,361 issued to Viitanen et al. describe electronic musical instruments that read through a stored attack waveform segment and then randomly repeat a recycled or steady state portion, through forward-only scanning or forward and reverse scanning.

All of these references deal with the providing of one note or sound from each oscillator. In an instrument that has fewer notes than oscillators, the user is unable to play the full spectrum of sounds that may be available individually. There thus remains a need for generating more notes than the number of available oscillators.

In order to generate a tone of different pitches, a single waveform is played at different read-out rates. Such a technique is described by Deutsch in U.S. Pat. No. 3,515,792. This results in the attack portion of the stored waveform being read out at a rate that is different than the original rate that was used to generate samples for storing the waveform. However, the natural instrument that creates the original sound will have an attack portion of the sound that does not vary linearly with the pitch or dominant frequency of the tone.

This phenomenon is also true of other forms of modulation of the base tone. Such time-varying characteristics, referred to generally as tremulant, including tremolo (amplitude modulation), vibrato (frequency modulation) and timbre (harmonic modulation), are not generally linearly related to the pitch.

As is described in the Gross et al. and Viitanen et al. patents, a common method of applying tremulant modulation to a signal, such as during the attack and decay portions of the tone generation, is to apply a modulation envelope to the signal, either before or after the read digital samples are converted into an analog signal. Such modulation schemes require separate components to manipulate the stored waveform signal. Also, the tremulant for some sounds is so complex that it is difficult to simulate artificially.

An alternative approach that has been used is disclosed by Wachi in U.S. Pat. No. 4,584,921. In that system, a separate attack waveform segment and sustain tone are stored for each pitch. This approach requires an extensive amount of memory.

There therefore remains a need for an electronic musical instrument that is capable of rendering attack and other modulation effects independent of pitch that has reduced memory and supporting components.

In the environment of tone generation in an instrument having fewer tone oscillators than tones, the user of the instrument is constrained to use only as many tones as there are oscillators. The user thus is not allowed to use all of the apparent resources of the instrument at a time. This clearly makes the machine less valuable to the user, and therefore cannot be sold for as much as an instrument having those capabilities.

A common characteristic of many inexpensive electronic musical instruments is the use of a central processor to generate the tones from several tone oscillators. This requires that the processor serially monitor each of the keys of the instrument and, in response to the status of the keys, control generation of the tones.

As a result each generator is not monitored constantly and is only periodically updated. The update frequency is fast enough to generate the tones, but can be too slow to allow jumps between disparate waveform cycles or segments in the memory without making undesired noise, or without ending up with a reading of memory segments not intended.

Such is the case in an instrument that is cycling through a waveform cycle or segment existing between a loop or start address location and an end address location. A current sample or phase address for reading is defined by calculating the position relative to a loop or end address. The current address is incremented a specified number of address locations between each read instruction. For instance, if the new current address is compared to the end address and it is past it, the current address is made equal to the loop address plus the difference between the end address and the current address.

Thus, the end address is used each time the current address is changed. If it is desired to jump to a different address, the results vary according to which direction in memory the jump is to be made. With the structure described, if the loop and end addresses are changed to forward or sequentially subsequent addresses, the memory between the current address and the new end address will all be read until the new end address is reached. A jump did not occur, but rather a progression to the newly defined segment.

If the start and end addresses are changed in the reverse or sequentially previous direction, then the new current address will be beyond the end address potentially more than the distance between the start and end addresses and the current address is changed to another one outside the new waveform segment. In order to avoid this discontinuity, the new end address is not changed until the current address reaches the prior end address, in which case the desired jump is completed.

These series of events would be reversed if each current address is compared to the loop address instead of the end address.

There thus also remains a need for an economically structured electronic musical instrument that has the capability to jump to noncontiguous waveform segments, whether one or a plurality of cycles, without reading any intervening segments.

SUMMARY OF THE INVENTION

These disadvantages of the known art are overcome by the present invention. The present invention provides switching between cluster segments or any waveform segments having desired characteristics. It also provides for controlling the play of tremulant effects independent of the associated pitch of the resulting sound. In this it is particularly useful for producing tremolo and attack or decay independently of variations in the pitch of the sound. In the preferred form of the invention, a method and apparatus is provided that provides for noiseless transitions between waveform segments in memory when a direct reassignment of waveform segment addresses cannot reliably be made. As used herein, sound refers to any resulting audio signal that is characterized by pitch, timbre, amplitude or combinations of them.

More particularly, the present invention provides a method and apparatus for jumping to noncontiguous waveform segments in a waveform table without requiring the use of elaborate hardware. Further, a method and apparatus is provided for reading selected waveform segments in order to control a modulation of the waveform independent of the pitch of the resultant audio output. Additionally, a method and apparatus is provided for providing waveform clustering in a single memory so that more sounds than oscillators can be played at a time.

These features are provided in the present invention by a method for reading selected waveform segments from a waveform stored in a memory of an electronic musical instrument having address registers containing the start address and end address of a waveform segment during reading for producing an audible tone. The method includes storing in the memory at sequential addresses a waveform having a plurality of cycles, with each cycle having a plurality of addressable samples and a predetermined characteristic. There are at least a first cycle with a first predetermined characteristic, such as a pitch, timbre, form of modulation, or combination of them, and a second cycle with a second predetermined characteristic different than the first predetermined characteristic. A first instruction selecting the first cycle is put into the electronic musical instrument. The selected first cycle is read from the memory. A second instruction selecting the second cycle is input into the instrument and the second selected cycle is read from memory, thereby producing different selected sounds from a single note generator.

In another aspect of the invention, an audio signal having a dominant frequency or pitch and a time-varying characteristic independent of the dominant frequency is produced. A waveform is sequentially sampled at a sampling rate, which waveform has a characteristic that varies at a first characteristic frequency less than the sampling rate. The waveform samples are stored sequentially in memory. Selected stored samples from distributed segments of the stored waveform are read at a reading rate different from and with a predetermined relationship to the sampling rate such that the characteristic varies at a second characteristic frequency not substantially equal to the first characteristic frequency times the ratio of the reading rate to the sampling rate.

These methods are provided in a preferred electronic musical instrument characterized by an inability to move directly between waveform segments separated in one direction in memory reliably without producing undesired noise in the resulting sound. The instrument includes a user input coupled to a processor for inputting an instruction selecting a first sound and an instruction selecting a second sound. The processor is responsive to the input instructions for serially controlling production of the selected sounds. A memory stores waveform segments corresponding to the selectable sounds, each waveform segment being stored digitally as sequentially addressable samples.

A first plurality of waveform segments are stored in a first region of memory, with each segment having a predetermined characteristic and being stored between known start and end addresses. A second waveform segment corresponding to the second sound is separated in memory in the one direction from a first waveform segment corresponding to the first sound. In a second region of the memory, in a direction reverse to the one direction from the first region, a second plurality of waveform segments are stored. Each waveform segment of the second plurality of waveform segments is stored between known start and end addresses that are different than the addresses of the first plurality of waveform segments, and is associated with and has the same predetermined characteristic as at least a predetermined one of the first plurality of waveform segments.

A selector is coupled to the processor for selecting the start and end addresses of waveform segments corresponding to selected sounds. An addressor, also coupled to the processor and to the memory means, reads waveform segments corresponding to selected start and end addresses.

The addressor reads a first waveform segment corresponding to the first selected sound by reading samples stored between the selected start and end addresses. After the instruction selecting the second sound is input, the selector selects the start and end addresses of the waveform segment of the second plurality of waveform segments associated with the selected second sound. The addressor terminates the reading of the first selected waveform segment and reads the waveform segment of the second plurality of waveform segments associated with the second sound selected by reading samples stored between the corresponding selected start and end addresses. The selector, during reading of the waveform segment of the second plurality of waveform segments, selects the start and end addresses corresponding to the second waveform segment.

The addressor terminates the reading of the waveform segment of the second plurality of waveform segments, and reads from the memory the second waveform segment by reading samples stored between the selected corresponding start and end addresses. Thus, a move is made in memory in the one direction by first reading an associated waveform segment in the reverse direction and thereby allowing time to move to the second waveform segment.

Such an instrument is thus able to jump to waveform segments in memory in both directions without making undesired noises during the transition. This technique allows such an instrument to jump between waveform segments of different or combined sounds and to cycle through a modulated waveform segment in a manner that allows control of the modulation frequency independently of the generated note frequency.

These and other features and advantages of the present invention will be apparent from the following detailed description of the preferred embodiment and associated drawings.

DETAILED DESCRIPTION OF THE PREFERRED EMBODIMENT

Figure 1:
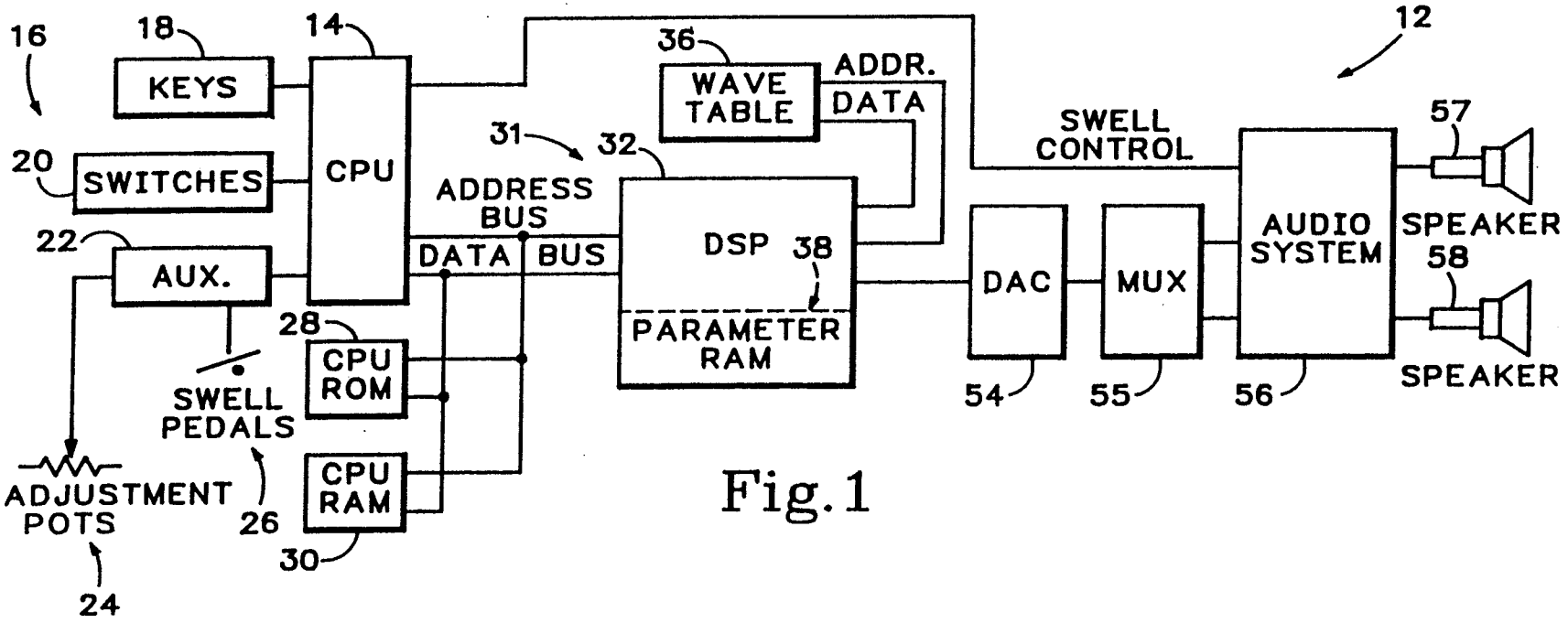
FIG. 1 is a block diagram of an electronic musical instrument made according to the invention.

Referring initially to FIG. 1, an electronic musical instrument 12, such as a music synthesizer or electronic organ, is shown. The structure and operation of electronic musical instruments is well known in the art, as is exemplified by the patents discussed previously. Instrument 12 is therefore discussed herein generically, with emphasis on those features of particular relevance to an apparatus for practicing the present invention.

Instrument 12 includes a central processor unit (CPU) 14 that controls the sensing of control or input devices, shown generally at 16, for input instructions into the CPU during operation. Input devices 16, in an electronic organ, typically include a plurality such as 61, of keys 18 of a keyboard, and switches or stops 20 and auxiliary controls 22 responsive to adjustment pots 24 and swell pedals 26 for further controlling the voices or sounds generated in response to activation of the keys. The stops define what is commonly referred to as registration, with a change in a device resulting in a change in registration.

The CPU is coupled to appropriate memory devices, such as a read-only memory (ROM) 28 that stores programs and fixed data, and a read/write or random-access memory (RAM) 30 that stores changeable data. Control information is conveyed to each of a plurality (such as 32) of oscillators, such as oscillator 31, that includes a digital-signal processor (DSP) 32. The DSP may be a commercially available integrated circuit or a combination of circuits providing generally known digital data manipulation as controlled by the processor.

Figure 2:
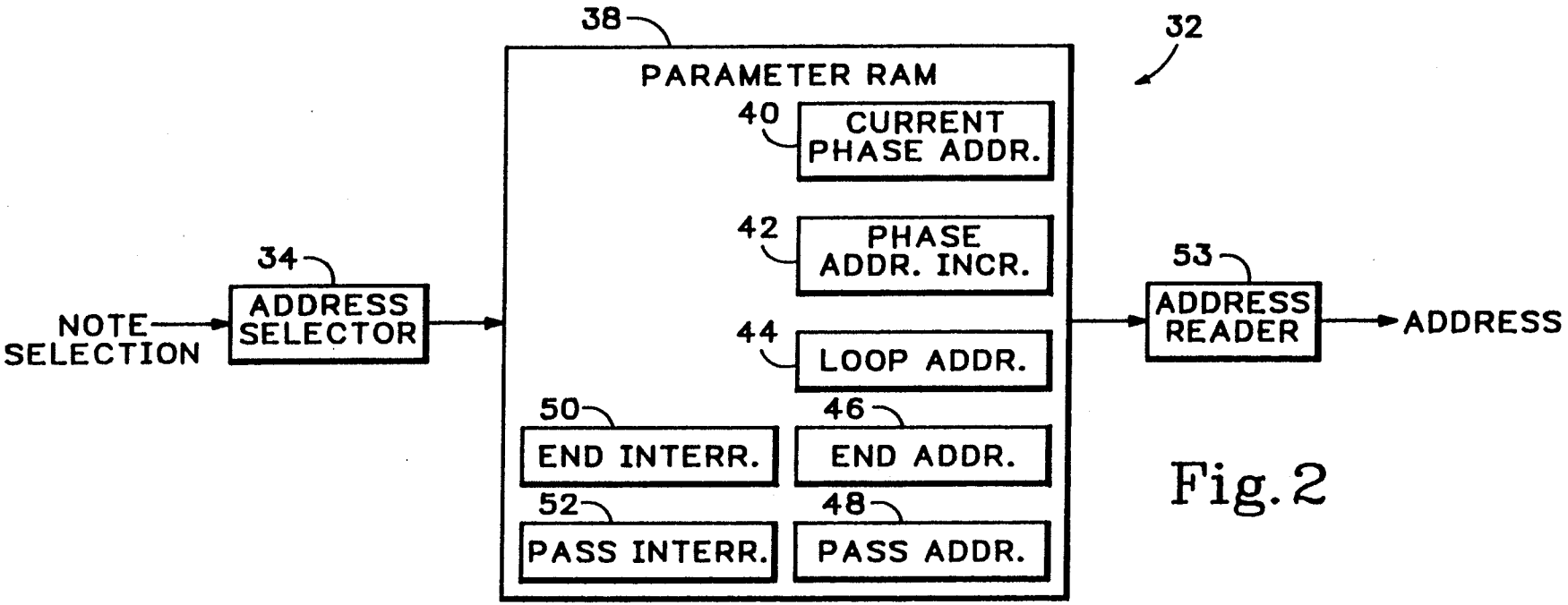
FIG. 2 is a block diagram of relevant functional portions of a digital signal processor used in the instrument of FIG. 1.

As particularly shown in FIG. 2, the DSP includes an address selector 34 that is responsive to a signal from the processor generated when an instruction is input selecting a desired output note. The address selector selects start and end addresses cf a waveform segment corresponding to the selected note, which waveform segment is stored in a wave table 36. The wave table has separately addressable memories (not shown), each associated with an oscillator and storing waveforms made up of distinctive waveform segments, as is illustrated by the remaining figures.

The address selector sets initial values for addresses and interrupts in a parameter RAM 38 contained within the DSP. Specifically, for purposes of illustrating the present invention, RAM 38 includes a current phase or sample register 40, a phase address increment register 42, a loop or start address register 44, an end address register 46, and a pass address register 48. Also included are interrupt registers 50 and 52 for end and pass interrupts, respectively. Use of these registers will be described with reference to the waveforms shown in the remaining figures.

An address reader 53 uses the values in these registers during reading of the waveforms stored in wave table 36. The waveform samples addressed by reader 53 are output to a digital-to-analog converter (DAC) 54 which converts digital values into an analog signal, as is well known in the industry. The analog signal is then fed by a multiplexer 55 into one of two speaker channels of an audio system 56 that modulates the signals as desired, such as with a swell control signal received from processor 14, as shown, and outputs them to stereo speakers 57 and 58.

Instrument 12 is a time-shared tone-generating system that preferably contains 32 oscillators or note generators having address selectors, parameter memories, address readers, and waveforms stored in the wave table. If the user plays at most ten notes at a time, then at most three stops can be used without using all of the oscillators. If it is stereo sound, which requires two oscillators per note per stop, this figure is cut in half.

Further, if a note is being played at the time stops are turned on or off, there should be no clicks or pops in the sound. It is also preferable that when a new note or stop is played, that an attack waveform segment associated with the note be played initially, in order to increase the realism of the resulting sound.

Thus, although it is best for ensemble performances that all notes have their own oscillators, this is not possible for low cost organs, which instrument 12 represents. In order to overcome this, samples of waveforms that combine two or more voices, or the combining of several sampled voices with signal processing tools, are used to make voice clusters.

Figures 3, 4, 5:
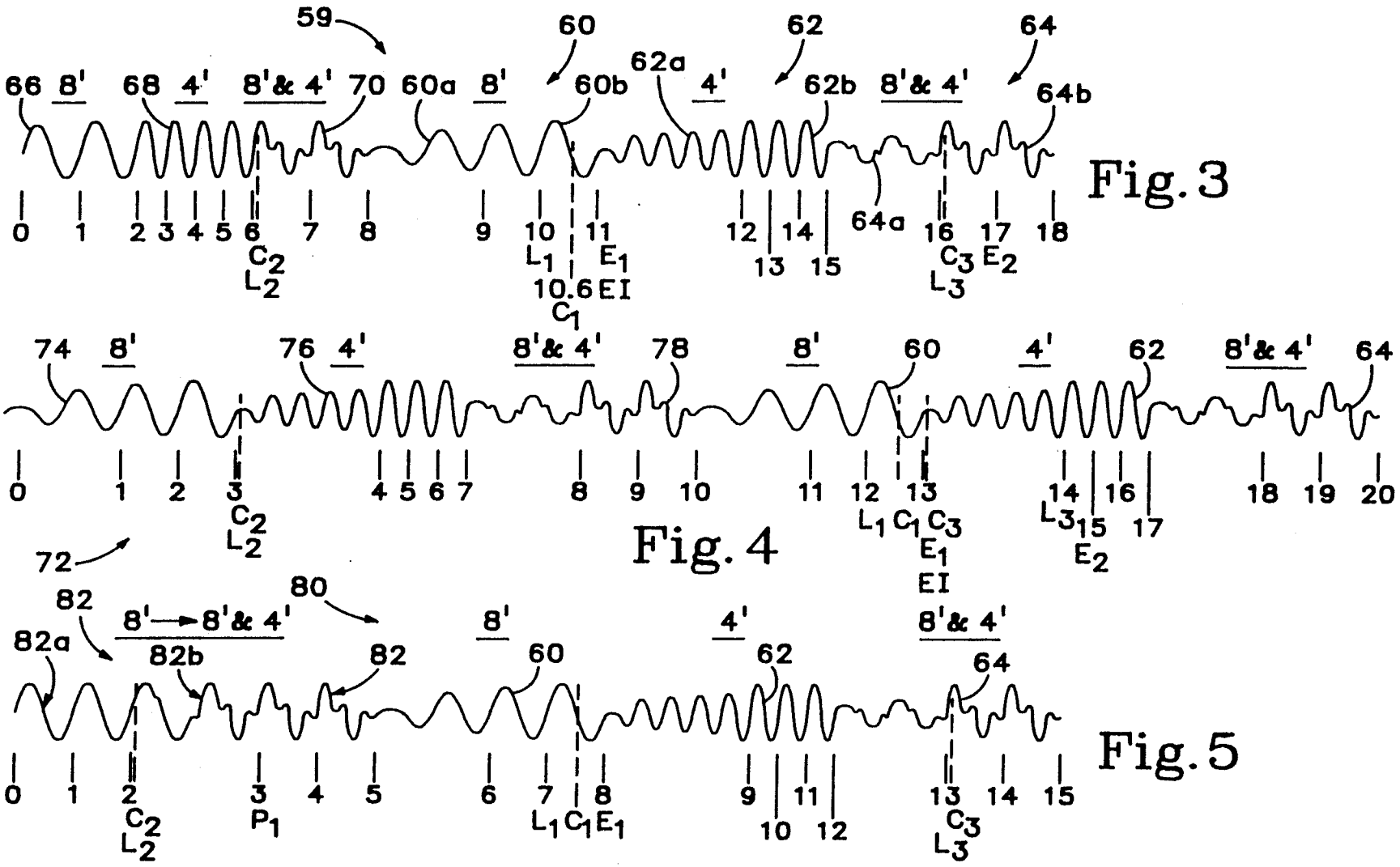
FIG. 3 is an exemplary waveform stored in the wave table of the instrument of FIG. 1 for practicing a first method of the invention.
FIG. 4 is an exemplary waveform stored in the wave table of the instrument of FIG. 1 for practicing a second method of the invention.
FIG. 5 is an exemplary waveform stored in the wave table of the instrument of FIG. I for practicing a third method of the invention.

For instance, as shown in the general waveform 59 of FIG. 3, separate simplified samples or waveform segments 60, 62 and 64 of an 8' flute, a 4' flute, and a combination of 8' and 4' flutes, respectively. Segments 60, 62 and 64 each include several cycles of attack portions 60*a*, 62*a* and 64*a*, followed by steady-state or sustain portions 60*b*, 62*b*, and 64*b*. When notes represented by any of these waveform segments are initiated, the attack portion is read out of memory and then the sustain portion is read repeatedly, using one of various known scanning techniques, until a key is released or a stop is changed.

The waveform of FIG. 3, as well as the other following figures, are illustrative rather than limiting. Other notes and clusters could also be provided. For three voices, there would be seven waveform segments. In general, for all possible combination of N stops, there are $2^N$-1 separate samples. So, for five stops to be combined, there would need to be 31 separate combinations.

Other clusters can be made of sounds from different families, like diapason, trumpet and string. These may be from the same or different octaves. One desirable type of arrangement is to put sounds that are not normally played at the same time in the same cluster. Most of the time each stop would be played from separate oscillators and the organ would have good ensemble. When the unlikely combinations are selected, they will still play but not have ensemble.

Three methods are proposed for switching between segments without making undesirable noises caused by the transition between segments. These are most effective when relatively few cycles of the steady-state portions of the segments are scanned at a time.

First, the preferred operation of the digital signal processor 32 is described. When a waveform, such as waveform 60 is selected by a key, the start and end addresses for the combined attack and steady-state portions and the address increment are retrieved from memory and assigned to registers 44, 46 and 42. The initial current phase address is set equal to the start address. The sequential samples are determined by adding the increment value to the last current phase address to obtain the next current phase address. This address is compared to the end address. If it is not past the end address, the sample is read from memory and a new current phase determined. The start and end addresses are set or changed according to the desired scanning technique.

This process continues until the current phase address exceeds the end address. The current phase address is then set to the value in the loop address register plus the difference between the end address and the current phase address (the amount the current phase address went past the end address).

If all of the oscillators are not being used, each sound is assigned to a separate oscillator. When the number of stops turned on exceeds the available oscillators, clusters are used for some of the stops. However, when all the oscillators are being used when the stops are changed, it is necessary to jump or switch to other waveform segments within the memory of the oscillator.

Since progression through the samples of a waveform segment occur as described, the loop register is safely changed to point to a lower address in the waveform memory, while the oscillator is functioning. After the current phase address is changed to an address associated with the waveform segment identified by the new loop address, there are many sample periods before the new end address must be written. A sample period of one oscillator is the time it takes the processor to process each of the other oscillators. If the loop register is changed to point to a higher address, at the time the original or previous end address is reached the oscillator would go to the new loop address, but within one sample period the end address would have to be changed to be beyond the revised loop address or the oscillator would skip through the whole waveform memory.

In order to compensate for this a technique that takes a little longer to complete is used. A small segment that is preferably a copy of a complete segment is placed in the waveform memory at lower addresses than the complete segment, and the small segments are grouped together, so that they are at lower addresses than the complete segments.

In FIG. 3, small segments 66, 68 and 70 correspond to, and are respective copies of a portion of complete segments 60, 62 and 64, respectively. More specifically, they are copies of the steady-state portions of the respective complete segments.

As the user is playing a sound such as the steady-state portion of waveform segment 60, and turns on a stop, the following steps are performed. The vertical lines below the waveforms represent zero crossings or other appropriate index for identifying the start and end of cycles or portions of the waveform that may be addressed. The associated reference numbers are simplified address identifiers, not an exact address, as each cycle is formed of a plurality of samples, not shown.

Any scanning processing is disabled. Assume that the loop address, $L_1$, is 10, the end address, $E_1$, is 11, and the current phase address, $C_1$, is 10.6. A new loop address, $L_2$, which points to the appropriate cluster segment 70, such as at address 6, is written. An end interrupt, EI, is set equal the present end address, 11.

When the end of the current cycle is reached, the oscillator immediately switches to waveform segment 70 by setting the current phase register to an address just above address 6, and an interrupt occurs. The address selector 34, functions as an interrupt handler and polls the current phase register until the phase or address changes. Since the current phase address is below $E_1$, the current phase will progress through waveform segment 70. When the current phase address changes, there is sufficient time, i.e., the full processor cycle time, to write new loop and end address values $L_3$ and $E_2$ corresponding to the steady-state portion of the complete waveform segment 64, as shown. The address difference between the small waveform segment 70 and the corresponding portion of segment 64 is then added to the value in the current phase register, for continued scanning of segment 64. The result is a clickless switch of the oscillator to the new waveform segment. With this method, the originally played sound can include an attack portion, but the cluster that is switched to cannot, since only a brief excursion is made into the segment with the lower addresses.

A variation of this method is shown by waveform 72 in FIG. 4 which still includes higher address segments 60, 62 and 64. However, instead of the lower address segments only having a portion of the steady-state of the segments, they also include an attack portion, as shown in corresponding segments 74, 76 and 78. It can be seen that waveform 72 can be used to perform the jump or move process just described, since only the steady-state portion of the lower segment need be addressed.

However, if it is desired to switch notes completely within the oscillator, this can be accomplished by addressing the beginning of the attack portion of the lower waveform segment, such as is represented by the same sequence of address values as described previously and shown in the figure. In this case, the oscillator completes the attack portion of the new higher-address waveform segment 62 before scanning in the steady-state portion. Since the loop address is not used until the end address is reached, the loop address can be higher than the initial current phase address, as shown.

A second method is used if it is desired to provide cluster switching with attack included in the new waveform segment. As shown in waveform 80 of FIG. 5, the same full cluster segments 60, 62 and 64 are used for the higher address segments. Only a single lower waveform segment 82 is illustrated. The other combinations would also be included in a complete waveform 80. As can be seen, waveform segment 82 consists of a steady-state portion 82*a* associated with waveform segment 60, a transitional portion 82*b* formed as a combination of the steady-state portion of segment 60 and the attack portion of segment 62, and a combination steady-state portion 82*c* corresponding to the steady-state portion of segment 64. There also preferably is a segment including the decay of each stop that may be turned off.

In this illustration, segment 60 is again being played initially, with the loop, end and current phase register values shown. Any scanning process is terminated. A new loop address is written that points to the beginning of appropriate cluster transition segment portion 82*b*, and a value, $P_1$, is set in pass register 48 to point to the beginning of steady-state portion 82*c*, which is address 3 in the figure, and the pass interrupt 52 is set.

When the end of the current cycle is reached, that is, when current phase exceeds the end address of 8, the oscillator immediately switches to segment 82 and sets the current phase to $C_2$, as shown. The transition segment portion 82*b* is played through until it reaches the steady-state portion 82*c* identified by $P_1$. At this time what is referred to as a pass interrupt occurs.

As described previously with the end interrupt, the current phase register is polled until the value changes. When this occurs it is safe to write new loop and end address values $L_3$ and $E_2$, and the current phase value $C_3$ adjusted to be in the steady-state portion of combination segment 64, as shown.

This method requires a significant amount of memory, due to the various transition segments required to accommodate all transition alternatives. It thus can be used in a very limited cases, such as for voices that have particularly noticeable attack transitions, in order to limit memory requirements.

A variation of the first method uses what may be referred to as a phantom or virtual copy of the set of waveform segments in order to accomplish a noiseless transition from one segment to another. This provides for processing by the first method as described particularly with reference to FIG. 4.

This method requires that the waveform segments 60, 62 and 64 be stored in the lower or upper half (or quarter, etc.) of an addressable memory space. Thus, if a 4 megasample memory is used with a digital signal processor that can address an 8-megasample memory space, the upper address bit is not used. Thus, by using both complementary values of 1 and 0 usable for the upper bit as though it is a real memory, the same memory is addressed by two different addresses. Thus, one copy of the waveform appears as two to the processor.

If the address associated with the higher bit is used for normal playing, then the lower address bit "copy" is used as the transitional memory, just like segments 74, 76 and 78. In FIG. 4, the three lower segments are between addresses 0 and 10 and the upper addresses are between 10 and 20. The lower addresses can be as two digits, 00, 01, 02, etc. Thus, except for the upper end addresses, each lower address—for the same waveform sample address—is the same as the upper address, except for the first or upper bit.

A jump "down" in loop address from 12 to 03, is actually an increase in true memory position, although computationally it is treated as lower. After the end interrupt and the new loop and end addresses have been written, there is no change in the actual address of the current phase, since the address difference is achieved by taking the complement of the upper address bit.

The above discussion has been made based on an oscillator that cannot always move to a waveform segment with an upper address quietly, since the incremental advance of the current phase address is computed using the end address. If the loop address happened to be used instead, the reverse would be true. That is movement upward in memory could be accomplished quietly, but movement downward would not necessarily be so. Thus, a method the reverse of that described would be appropriate for accomplishing quiet moves in both directions.

The capability of jumping to different waveform segments in a waveform memory as has just been described, also provides for the capability to selectively move within a waveform to achieve other advantageous results. For instance, many natural sounds have some form of modulation with a frequency slower than the pitch or dominant frequency of the sustain or continued tone. Examples include tremulant, attack and decay of a sound.

A sampled sound having a particular pitch or dominant frequency is often used to produce sounds at different pitches. Otherwise it would be necessary to store a waveform for each pitch. The different pitches are accomplished by reading the samples at a rate that is faster or slower than the rate at which the sound was originally sampled. Any modulation of the sound is correspondingly faster or slower as well. Many systems use constant or normalized steady-state samples and then apply artificially the pitch, amplitude or timbre modulation in the playback process. However, as has been mentioned, the tremulant of some sounds is so complex that it is difficult to simulate artificially.

In accordance with the present invention, a complete waveform is sampled, including the transient and tremulant effects, and then read in a manner that generates the transient or tremulant effects independently of the change in pitch of the sound when read out.

Figure 6:
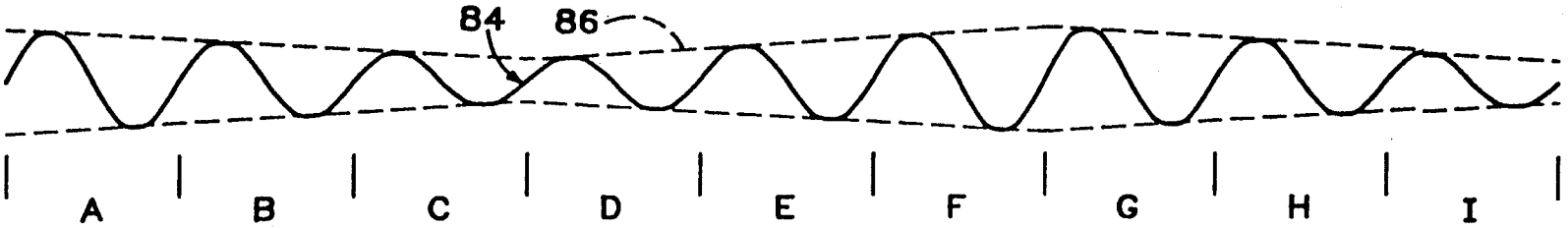
FIG. 6 is an exemplary waveform stored in the wave table of the instrument of FIG. 1 for practicing a fourth method of the invention.

A sample of the original sound is taken, as represented by waveform 84 in FIG. 6. As shown by dashed outline 86, there is a tremolo effect that varies the amplitude of the waveform. The individual sinusoidal cycles are identified by the alphabetical letters indicated, for purposes of illustration. In actuality, two (real or phantom) copies of the waveform are stored in memory to accommodate movement to different parts of the waveform as described with reference to FIGS. 3–5.

Figure 7:
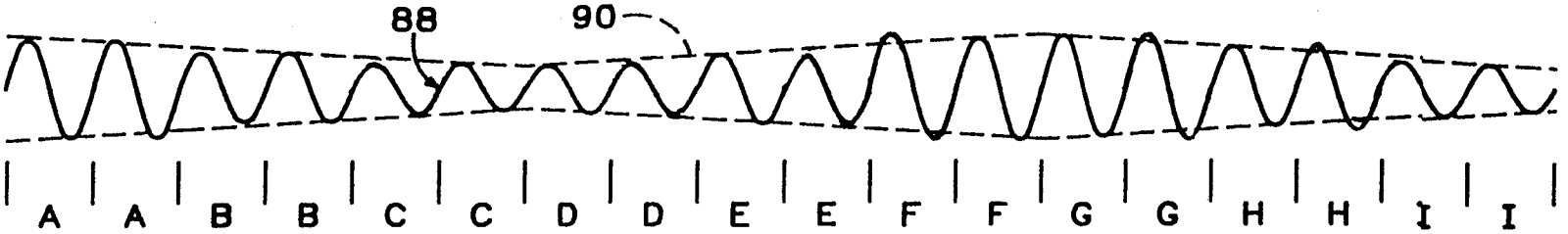
FIGS. 7 and 8 are two exemplary output waveforms resulting from a reading of the waveform of FIG. 6 using the fourth method of the invention.

In order to achieve an increase in pitch of a generated sound, as represented by waveform 88 in FIG. 7, selected ones of the cycles of waveform 84 may be repeated. A doubling of the pitch, as illustrated, would normally result in a doubling of the frequency of the tremolo. However, by repeating each of the cycles sequentially, as shown in FIG. 7, a tremolo envelope 90 is produced that has the same frequency as original tremolo envelope 86. The true envelope actually would have slight variations in it due to the played cycles not conforming precisely to the envelope.

Figure 8:
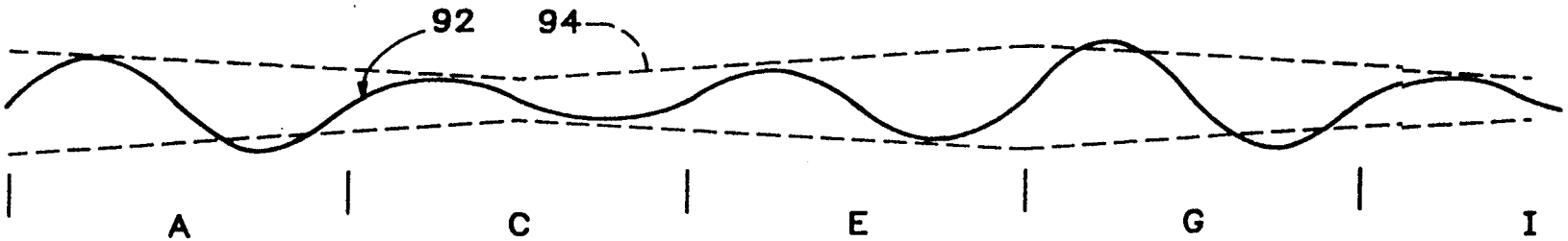

FIG. 8 illustrates the reverse situation in which the fundamental pitch of the waveform is half that of waveform 84, as is represented by waveform 92. In this case, alternate cycles of the stored waveform are read from memory to produce the desired pitch, and the target tremolo envelope 94 again has the same frequency as original envelope 86. As before, variations between the idealized envelope and true envelope occur, since the stretched cycles do not have amplitudes conforming strictly to the envelope shown.

By selecting other combinations of cycles, the tremolo cycle can be made to have substantially any frequency desired.

Figure 9:
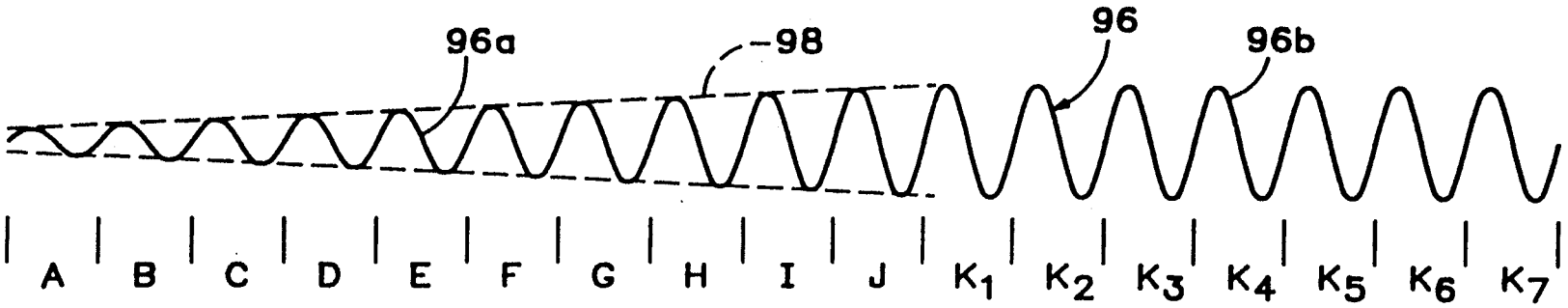
FIG. 9 is an exemplary waveform stored in the wave table of the instrument of FIG. 1 for practicing a variation of the fourth method of the invention.
Figure 10:
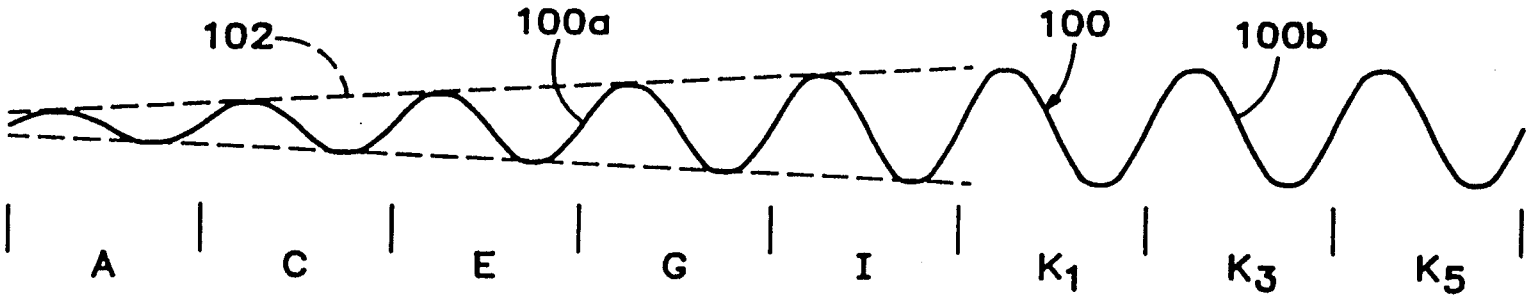
FIG. 10 is an exemplary output waveform resulting from a reading of the waveform of FIG. 9 using the variation of the fourth method of the invention.

The application of this technique to a nonrepeating modulation is illustrated in FIGS. 9 and 10. FIG. 9 represents an original waveform 96 having a simplified attack portion 96*a* with increasing amplitude defined by envelope 98, and a sustain portion 96*b*, that may have tremulant, as just described. Again, the individual cycles are shown sequentially with alphabetic indicators. The sustain portion is identified with repeated versions of a cycle identified by the letter K.

FIG. 10 illustrates a playback sound having a waveform 100 with half the pitch of waveform 96. Alternate cycles are read out, producing an attack portion 100*a* generally represented by envelope 102, and a sustain portion 100*b*. Depending on the characteristics of the sustain portion, alternate cycles, as shown, could also be read out, or it could be scanned or repeated according to desired output effects.

It will thus be appreciated that the method and apparatus of the present invention can be used to achieve various results. It provides a method of jumping to different cycles or waveform segments within a waveform stored in memory, while allowing oscillator sharing, cluster switching, and transient and tremulant modulations independent of the pitch of the base waveform.

Thus, it will be apparent to one skilled in the art that variations in form and detail may be made in the preferred embodiment and method of practicing the invention without varying from the spirit and scope of the invention as defined in the claims. The preferred embodiment and method are thus provided for purposes of explanation and illustration, but not limitation.

I claim:

1. A method of changing stops played on an electronic musical instrument comprising the sequential steps of:

storing in a memory at sequential addresses samples of a waveform, the waveform having a plurality of waveform segments, each waveform segment having at least one cycle and being representative of a predetermined musical registration, and there being at least a first waveform segment representative of a first musical registration and a second waveform segment representative of a second musical registration different than the first musical registration; where a location of a stored sample relative to an other stored sample is in a forward direction if the direction is consistent with the sequence of addresses of the waveform samples and is in a reverse direction if the direction is opposite to the sequence of addresses of the waveform samples and the instrument is unable to move directly from one waveform segment to another waveform segment different than the one waveform segment, which other waveform segment is located in one of the forward or reverse directions in memory from the one waveform segment reliably without producing undesired noise in the resulting sound and is able to move from the other waveform segment to the one waveform segment reliably without producing undesired noise; and wherein the step of storing includes storing the second waveform segment in a location that is in the one direction in memory from the first waveform segment, and storing a third waveform segment at a location that is in the other direction from the first waveform segment, with the third waveform segment being the same as the second waveform segment;

inputting a first instruction selecting the first musical registration;

identifying in response to the first instruction the first waveform segment;

reading from the memory stored samples of the identified first waveform segment;

inputting, during reading of the first waveform segment, a second instruction selecting the second musical registration;

identifying in response to the second instruction the second waveform segment; reading from the memory stored samples of the third waveform segment; and reading from the memory stored samples of the identified second waveform segment;

whereby movement from the first waveform segment to the third waveform segment and movement from the third waveform segment to the second waveform segment are without noise.

2. A method according to claim 1 wherein the step of storing includes storing an attack waveform segment sequentially adjacent to and prior to each of the first and third waveform segments, which attack waveform segments correspond to the associated sounds of the first and third waveform segments, and the steps of reading the first and third waveform segments includes reading the corresponding attack waveform segments prior to reading the respective first and third waveform segments.

3. A method of producing an audio signal having an audio dominant frequency and a time-varying characteristic independent of the audio dominant frequency comprising the steps of:

sampling sequentially a waveform having a waveform dominant frequency at a sampling rate, which waveform has a characteristic that varies at a first characteristic frequency less than the waveform dominant frequency;

storing the waveform samples sequentially;

reading samples of segments of the stored waveform at a reading rate appropriate for producing an audio signal having an audio dominant frequency different from and with a predetermined relationship to the waveform dominant frequency such that the characteristic varies at a second characteristic frequency not equal to the first characteristic frequency times the ratio of the audio dominant frequency to the waveform dominant frequency; and producing from the read samples an audio signal having the audio dominant frequency and the characteristic varies at the second characteristic frequency.

4. A method according to claim 3 wherein the second characteristic frequency is substantially equal to the first characteristic frequency.

5. A method of reading selected waveform segments from a waveform stored in a memory of an electronic musical instrument having address registers for storing, during reading, a start address and an end address of a waveform segment, the method comprising the sequential steps of:

storing in the memory at sequential addresses a first copy and a second copy of a waveform segment having a plurality of cycles of a tone having a dominant pitch, with the cycles of the waveform segment being modulated at a frequency less than the dominant pitch;

putting into the electronic musical instrument an instruction selecting the waveform segment for playing at a pitch different than the dominant pitch;

selectively reading from the memory ordered cycles of at least one of the first and second copies of the selected waveform segment at a rate corresponding to the different pitch, such that the resulting read waveform segment is modulated at a frequency different than the modulation frequency multiplied by the ratio of the different pitch and the dominant pitch.

6. A method according to claim 5 where the different pitch is less than the dominant pitch and the step of reading includes reading noncontiguous periods of the waveform segment by reading alternatingly from the first and second copies of the waveform segment.

7. A method according to claim 5 where the different pitch is greater than the dominant pitch and the step of reading includes repeated reading of contiguous periods of the first copy of the waveform segment.

8. A method of reading selected waveform segments from a waveform stored digitally as ordered addressable samples in a memory of an electronic musical instrument having fewer oscillators than selectable sounds, which oscillators are controlled serially by a processor, wherein a sample is positioned in memory relative to another sample in a first direction corresponding to the order of the associated addresses, and the processor does not sequentially read the first sample of a waveform segment positioned in one of the first direction or in a second direction reverse to the first direction in memory from the last sample of another waveform segment reliably without producing undesired noise in the resulting sound, the method comprising the steps of:

storing in a first region of the memory one plurality of waveform segments with each segment having a predetermined characteristic and being stored between respective known start and end addresses;

storing in a second region of the memory, which region is located in the second direction from the first region, another plurality of waveform segments, with each waveform segment of the other plurality of waveform segments being stored between respective known start and end addresses that are different than the addresses of the one plurality of waveform segments, and being associated with and having the same predetermined characteristic as at least a predetermined one of the one plurality of waveform segments;

putting into the electronic musical instrument an instruction selecting a first one of the one plurality of waveform segments;

selecting the respective start and end addresses of the first waveform segment;

reading the first selected waveform segment by reading samples stored between the selected start and end addresses of the first waveform segment and progressing toward the end address of the first waveform segment;

putting into the electronic musical instrument an instruction selecting a second one of the one plurality of waveform segments, which second waveform segment is in the first direction in memory from the first waveform segment;

selecting the respective start and end addresses of the waveform segment of the other plurality of waveform segments associated with the selected second waveform segment;

terminating the reading of the first selected waveform segment;

reading from the memory of the waveform segment of the other plurality of waveforms associated with the selected second waveform segment by reading samples stored between the selected respective start and end addresses of the waveform segment of the other plurality of waveform segments associated with the selected second waveform segment and progressing toward the respective end address of the waveform segment of the other plurality of waveform segments associated with the selected second waveform segment;

during reading from the memory the waveform segment associated with the second waveform segment, selecting the respective start and end addresses of the second waveform segment;

terminating the reading of the waveform segment of the other plurality of waveform segments associated with the selected second waveform segment; and reading from the memory the second waveform segment by reading samples stored between the selected respective start and end addresses of the second waveform segment and progressing toward the respective end address of the second waveform segment.

9. A method according to claim 8 further comprising, during each step of reading, reading successively selected current sample addresses and determining, prior to reading the sample associated with each current sample address, whether the current sample address is beyond the end address; and the one direction in memory is the direction of sequentially higher addresses.

10. A method according to claim 9 wherein said steps of reading the first waveform segment, and selecting start and end addresses of and reading the waveform segment in the other plurality of waveform segments include, after the step of putting in the instruction selecting the second waveform segment and while reading the first selected waveform segment, selecting the start address of the waveform segment in the other plurality of waveform segments, reading through the first waveform segment until the end address is reached, terminating reading of the first waveform segment, reading the waveform segment in the other plurality of waveform segments beginning with the start address, and then selecting the end address of the waveform segment of the other plurality of waveform segments.

11. A method according to claim 10 wherein the step of terminating the reading of the first waveform segment includes setting a read interrupt at an address of the first waveform segment yet to be read, and terminating the reading of the first waveform segment when the address having the interrupt is reached.

12. A method according to claim 9 wherein the second waveform segment is a steady state portion of a waveform, and the waveform segment of the other plurality of waveform segments associated with the second waveform segment includes an attack portion and the steady state portion, and the step of selecting the start and end addresses includes selecting a start address associated with the attack portion and selecting an end address associated with the steady-state portion.

13. A method of reading selected waveform segments from a waveform stored digitally as addressable samples in a memory of an electronic musical instrument having fewer oscillators that selectable sounds, which oscillators are controlled serially by a processor, wherein a sample is positioned in memory relative to another sample in a direction corresponding to the order of the associated addresses, and the processor does not sequentially read the first sample of a waveform segment positioned in a first direction in memory from the last sample of another waveform segment reliably without producing undesired noise in the resulting sound, the method comprising the steps of:

storing in a portion of the memory a plurality of waveform segments with each segment having a predetermined characteristic and being stored between known respective start and end addresses, which addresses are unique in the plurality of waveform segments and include a known common bit that has a common value for all addresses associated with the stored waveform segments and also has a complementary value;

putting into the electronic musical instrument an instruction selecting a first one of the waveform segments;

selecting respective start and end addresses in the first waveform segment with a predetermined value of the common bit such that movement to a position in memory that is in a direction reverse to the first direction corresponds to a change of the value of the common bit from the predetermined value to the complement of the predetermined value;

reading the first waveform segment by reading samples stored between the selected respective start and end addresses;

putting into the electronic musical instrument an instruction selecting a second one of the waveform segments, which second waveform segment is in the first direction in memory from the first waveform segment;

selecting respective start and end addresses of the second selected waveform segment having a common bit value the complement of the predetermined value;

terminating the reading of the first selected waveform segment;

reading from the memory the second waveform segment by reading samples stored between the selected respective start and end addresses using a common bit value that is the complement of the predetermined value;

during reading from the memory the second wave form segment using a common bit value that is the complement of the predetermined value, changing the common bit value to the predetermined value;

terminating the reading of the second waveform segment using a common bit value that is the complement of the predetermined value; and reading from the memory the second wave form by reading samples stored between the selected respective start and end addresses having a common bit with the predetermined value.

14. An electronic musical instrument for reading waveform segments of a waveform stored in a memory of an electronic musical instrument having address registers containing, during reading, the start address and end address of a waveform segment for producing an audible sound, the waveform segments being representative of different musical registrations, the instrument comprising:

waveform memory means for storing a plurality of waveform segments sequentially at sequential addresses with each waveform segment having at least one cycle and being representative of a predetermined musical registration, with each cycle having a plurality of addressable samples and there being at least a first waveform segment representative of a first musical registration and a second waveform segment representative of a second musical registration different than the first musical registration; and a sample is positioned in memory relative to another sample in a direction corresponding to the order of the associated addresses;

input means for inputting sequentially first and second instructions selecting, respectively, a first musical registration and a second musical registration corresponding to the first and second waveform segments stored in the memory means;

means responsive to input instructions for identifying the waveform segments corresponding to the selected musical registrations;

means responsive to the identified waveform segments for reading from the memory means the identified waveform segments, the reading means being unable to read sequentially the first sample of a waveform segment positioned in a first direction in memory from the last sample of another waveform segment reliably without producing undesired noise in the resulting sound; and said memory means stores a third waveform segment at selected addresses that are at addresses in a direction reverse to the first direction relative to addresses of the first and second waveform segments, with the third waveform segment representing a sound the same as the second waveform segment; whereby the reading means reads the first waveform segment in response to the first instruction until the second instruction is input, and then terminates the reading of the first waveform segment, reads the third waveform segment, and then reads the second waveform segment; and means coupled to the memory means for producing sounds representative of the corresponding waveform segments.

15. An instrument according to claim 14 wherein the memory means stores an attack waveform segment with each of the first and third waveform segments, which attack waveform segments correspond to the associated sounds of the first and third waveform segments, and the reading means reads the corresponding attack waveform segments prior to reading the respective first and third waveform segments.

16. An electronic musical instrument comprising:

input means for inputting sequentially an instruction selecting a first sound and an instruction selecting a second sound;

processor means responsive to the input instructions for serially controlling production of the selected sounds;

memory means for storing waveform segments corresponding to the selectable sounds, each waveform segment being stored digitally as sequentially addressable samples, including storing in a first region of memory one plurality of waveform segments, including a first waveform segment having a predetermined characteristic associated with the first sound and being stored at a first position between known respective start and end addresses, and a second waveform segment having a predetermined characteristic associated with the second sound which second waveform segment is stored between known respective start and end addresses in memory at a second position that is in a known one direction from the first position of the first waveform segment; and storing in a second region of the memory, located in a direction reverse to the one direction from the first region, another plurality of waveform segments, with each waveform segment of the other plurality of waveform segments being stored between known respective start and end addresses that are different than the addresses of the one plurality of waveform segments, and being associated with and having the same predetermined characteristic as at least a predetermined one of the one plurality of waveform segments;

means coupled to the processor means for selecting the respective start and end addresses of waveform segments corresponding to selected sounds;

means coupled to the selecting means and to the memory means for reading waveform segments corresponding to selected respective start and end addresses, the reading means being unable to move directly from one waveform segment to another waveform segment located at a position that is in the one direction in memory reliably without producing undesired noise in the resulting sound;

the reading means reading a first waveform segment corresponding to the first selected sound by reading samples stored between the selected respective start and end addresses; and after the instruction selecting the second sound is input, the selecting means selecting the respective start and end addresses of the waveform segment of the other plurality of waveform segments associated with the selected sound; the reading means terminating the reading of the first selected waveform segment and reading the waveform segment of the other plurality of waveform segments associated with the selected sound by reading samples stored between the corresponding selected respective start and end addresses; the selecting means, during reading of the waveform segment of the other plurality of waveform segments, selecting the respective start and end addresses corresponding to the second waveform segment; and the reading means terminating the reading of the waveform segment of the other plurality of waveform segments, and reading from the memory the second waveform segment by reading samples stored between the selected corresponding respective start and end addresses, whereby a move in memory to a waveform segment located in the one direction occurs by first reading the associated waveform segment located in the reverse direction.

17. An instrument according to claim 16 wherein the reading means reads successively selected current sample addresses and determines, prior to reading the sample associated with each current sample address, whether the current sample address is beyond the end address; whereby the one direction in memory is the direction of sequentially higher addresses.

18. An instrument according to claim 17 wherein the selecting means, after the instruction selecting the second sound is input and while the reading means is reading the first waveform segment, selects the start address of the waveform segment in the other plurality of waveform segments, the reading means reads through the first waveform segment until the end address is reached, terminates reading of the first waveform segment, and reads the selected waveform segment in the other plurality of waveform segments beginning with the start address, and then the selecting means selects the end address of the selected waveform segment of the other plurality of waveform segments.

19. An instrument according to claim 18 wherein the selecting means, after selecting the start address of the selected waveform segment of the other plurality of waveform segments, sets a read interrupt at an address of the first waveform segment yet to be read, and the reading means is responsive to the read interrupt for terminating the reading of the first waveform segment by terminating the reading of the first waveform segment when the address having the interrupt is reached.

20. An instrument according to claim 17 wherein the second waveform segment represents a steady state portion of a waveform, and the waveform segment of the other plurality of waveform segments associated with the second waveform segment includes an attack portion and the steady state portion, and the selecting means selects a start address associated with the attack portion and selects an end address associated with the steady-state portion.

21. An electronic musical instrument comprising:

input means coupled to the processor means for inputting sequentially an instruction selecting a first sound and an instruction selecting a second sound;

processor means responsive to the input instructions for serially controlling production of the selected sounds;

memory means for storing a plurality of waveform segments corresponding to the selectable sounds, each waveform segment being stored digitally as sequentially addressable samples between known respective start and end addresses and being representative of a sound having a predetermined characteristic, the addresses of each waveform segment being unique and including a known common bit that has a predetermined value for all addresses associated with the stored waveform segments, which predetermined value is one of two complementary values;

means coupled to the processor means for selecting the respective start and end addresses of waveform segments corresponding to selected sounds, which addresses selectively may have either one of the two complementary values for the common bit;

means coupled to the selecting means and to the memory means for reading waveform segments corresponding to selected respective start and end addresses by using the predetermined value for the common bit regardless of the selected value of the common bit, the reading means being unable to move directly from one waveform segment to another waveform segment located at a position that is in a known one direction in memory reliably without producing undesired noise in the resulting sound;

the reading means reading a first waveform segment corresponding to the first selected sound by reading samples stored between the respective selected start and end addresses; and after the instruction selecting the second sound is input, the selecting means selecting the respective start and end addresses of the waveform segment associated with the second selected sound using the value of the common bit that is the complement of the predetermined value; the reading means terminating the reading of the first selected waveform segment and reading the second selected waveform segment associated with the second selected sound by reading samples stored between the corresponding selected respective start and end addresses; the selecting means changing the value of the common bit to the predetermined value during reading of the second selected waveform segment using the value of the common bit that is the complement of the predetermined value; and the reading means terminating the reading of the second waveform segment using the value of the common bit that is the complement of the predetermined value, and completing reading from the memory the second waveform segment using the predetermined value of the common bit.

* * * * *